United States Patent [19]

Okazaki

[11] Patent Number: 4,522,602

[45] Date of Patent: Jun. 11, 1985

[54] INTAKE SYSTEM FOR OUTBOARD MOTORS

[75] Inventor: Masaki Okazaki, Shizuoka, Japan

[73] Assignees: Yamaha Hatsudoki Kabushiki Kaisha; Sanshin Kogyo Kabushiki Kaisha, both of Japan

[21] Appl. No.: 486,668

[22] Filed: Apr. 20, 1983

[30] Foreign Application Priority Data

May 7, 1982 [JP] Japan ..... 57-76154

[51] Int. Cl.[3] ..... B63H 21/26

[52] U.S. Cl. ..... 440/77; 123/195 C; 123/198 E; 440/88

[58] Field of Search ..... 440/77, 88; 123/198 E, 123/195 P, 195 C; 181/229; 285/235

[56] References Cited

U.S. PATENT DOCUMENTS

| | | | |
|---|---|---|---|
| 2,756,736 | 7/1956 | Kiekhaefer | 123/198 |
| 2,798,470 | 7/1957 | Kiekhaefer | 123/198 E |
| 2,815,742 | 12/1957 | Kiekhaefer | 123/198 |
| 2,839,042 | 6/1958 | Armstrong et al. | 123/198 E |
| 2,914,133 | 11/1959 | Johnson | 181/229 |
| 3,100,658 | 8/1963 | Miller et al. | 285/235 X |
| 3,195,530 | 7/1965 | Heidner | 123/198 |
| 3,557,902 | 1/1971 | Brown | 181/35 |
| 3,810,526 | 5/1974 | Kawasaki | 181/229 |
| 4,379,702 | 4/1983 | Takada et al. | 440/77 |

FOREIGN PATENT DOCUMENTS

| | | |
|---|---|---|
| 1374264 | 12/1964 | France . |
| 52-27506 | 6/1977 | Japan . |
| 554524 | 7/1943 | United Kingdom . |

*Primary Examiner*—Sherman D. Basinger
*Attorney, Agent, or Firm*—Ernest A. Beutler

[57] ABSTRACT

Several embodiments of outer cowling arrangements for outboard motors that provide a silencing air chamber between the forward portion of the engine and an operator of the motor. In addition to providing a sound deadening space, the air chamber functions as a silencing device for the induction system of the engine. In some embodiments, the air chamber is defined by a partition that is affixed to the outer cowling and in other embodiments, this partition is affixed to the engine.

10 Claims, 4 Drawing Figures

INTAKE SYSTEM FOR OUTBOARD MOTORS

BACKGROUND OF THE INVENTION

This invention relates to an intake system for outboard motors and more particularly to an improved protective cowling for such motors.

With any internal combustion engine, there are a variety of noises generated by the engine during its running. These noises emanate from three main sources: the induction system, the exhaust system and mechanical noises. When the engine is used in conjunction with an outboard motor, the engine is disposed above the water line and in close proximity to the associated watercraft, its operator and its occupants. Although it is the practice to use underwater exhaust discharges to improve exhaust silencing, the induction system and mechanical noises are present and in close proximity to the operator and passengers, as aforenoted.

It has been proposed to provide a protective cowling having sound deadening material so as to isolate some of the engine induction and mechanical noises. However, the sound deadening materials used for this purpose are generally water absorbent. As a result, they may cause moisture to accumulate in the area surrounding the engine and can damage its electrical and other components.

Arrangements have also been provided for silencing the induction noises through use of baffles and the like. Of course, the relatively small area and the desire to keep the motor as compact as possible, can significantly reduce the effect of silencing that is possible for the induction system.

It is, therefore, a principal object of this invention to provide an improved intake system for outboard motors.

It is another object of this invention to provide a protective cowling arrangement for the engine of an outboard motor that will significantly improve silencing.

It is a further object of this invention to provide a silencing protective cowling for an outboard motor that does not significantly increase the size and/or weight.

SUMMARY OF THE INVENTION

This invention is adapted to be embodied in an induction system for an outboard motor or the like comprising an engine having an induction system air intake and a protective cowling substantially enclosing the engine. In accordance with the invention, a partition extends substantially across the rear side of the front face of the protective cowling to define an air chamber between the engine and an operator of the outboard motor or the like. An air inlet is provided into the air chamber and an air outlet communicates the air chamber with the induction system air inlet.

DETAILED DESCRIPTION OF THE PREFERRED EMBODIMENTS OF THE INVENTION

Figure 1:
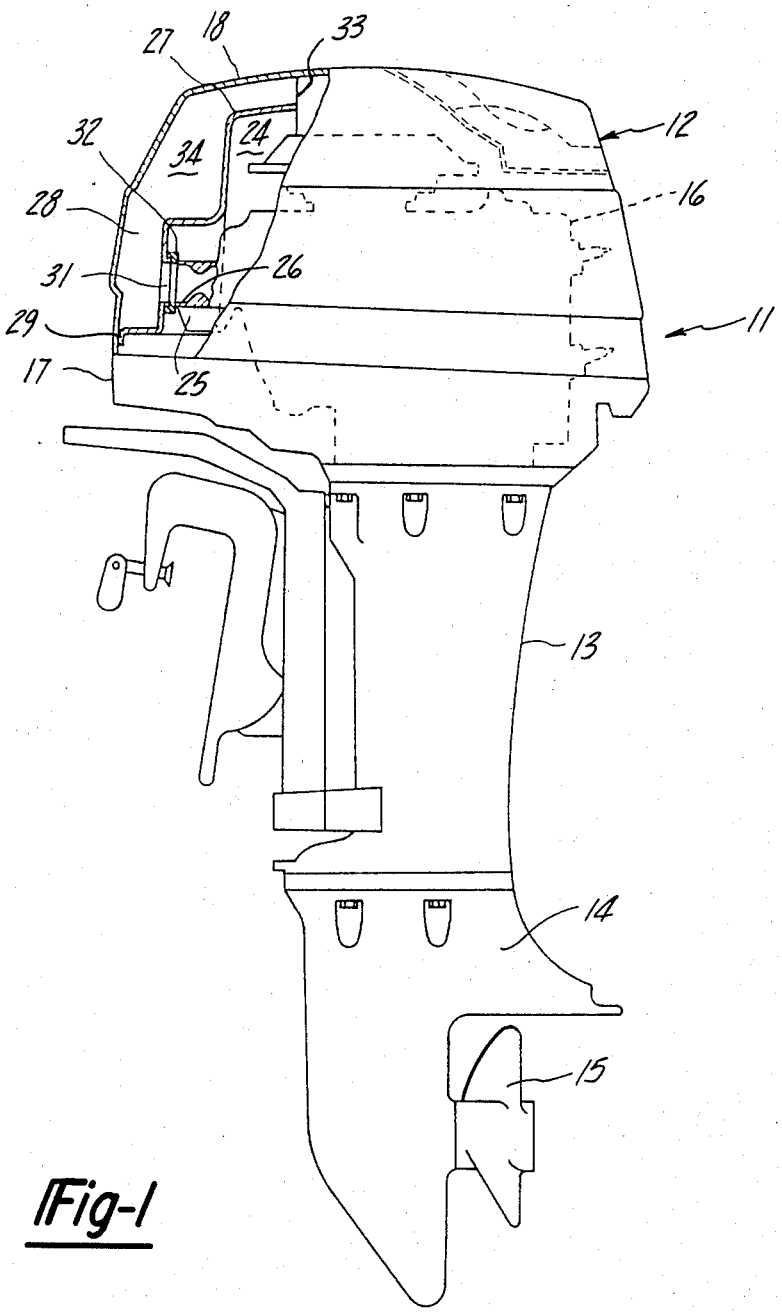
FIG. 1 is a side elevational view of an outboard motor constructed in accordance with an embodiment of this invention, with a portion broken away and shown in section.
Figure 2:
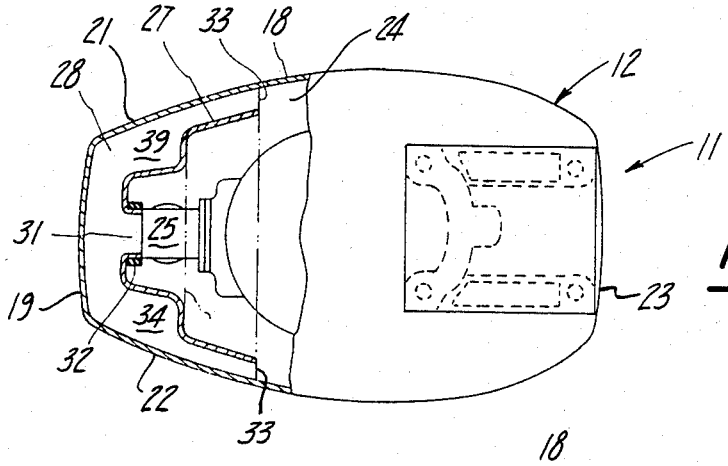
FIG. 2 is a top plan view of the embodiment shown in FIG. 1, with a portion broken away and shown in section.

Referring first to the embodiment of FIGS. 1 and 2, an outboard motor constructed in accordance with an embodiment of the invention is identified generally by the reference numeral 11. The outboard motor includes a power head 12 from which a drive shaft housing 13 depends. A lower unit 14 is affixed to the drive shaft housing 13 and contains a propeller 15 that is driven in a known manner.

The power head 12 includes an internal combustion engine 16 and a surrounding protective cowling comprised of a tray portion 17 and a main cowling portion 18. The cowling assembly may be made up of any suitable material such as fiberglass reinforced plastic. The main cowling portion 18 has a front face 19 that is disposed in proximity to the operator and passengers of the associated watercraft when in use, integral side portions 21 and 22 and a rear portion 23. The cowling assembly defines a cavity 24 in which the engine 16 is located.

An appropriate air inlet to the cavity 24 is provided in the rear face 23 of the main cowling member 18. This air inlet is designed so as to prevent the entry of water into the cavity 24 and may be of the type shown in Japanese Utility Model application which was laid open under Publication No. 54-163496 of Japanese Patent application which was published under Publication No. 56-99893, each of which is owned by the assignees of this application. A corresponding United States application relating thereto has now issued as U.S. Pat. No. 4,379,702, on Apr. 12, 1983, and is herein incorporated by reference.

The engine 16 is provided with an induction system which includes a carburetor 25 having an air inlet 26.

In accordance with this invention, a partition 27 is provided that is substantially coextensive with the main cowling member front face 19 and which extends rearwardly a substantial distance along the front portion of the sides 21 and 22. This defines a cavity 28 which is positioned between the outer cowling 18 and the partition 27 and which is disposed between the engine 16 and the watercraft operator and passengers. The partition 27 has a outstanding flange 29 around the major portion of its periphery that is engaged with and affixed in any suitable manner to the main cowling member 18.

The partition 19 is formed with a generally annular rearwardly directed flange that defines an air outlet opening 31. The air outlet opening 31 cooperates with the carburetor air inlet 26 to supply induction system air for the engine 16. An annular sealing member 32 encircles the flange 31 and engages the carburetor around its inlet opening 26 so as to provide a seal against air leakage.

Air is admitted to the air cavity 28 from the outer cowling cavity 24 by means of a pair of inlet openings 33 formed by the rearwardly extending portions of the partition 27. As may be readily apparent from FIGS. 1 and 2, the rearwardly ending portions of the partition 27 are spaced from the corresponding outer cowling sides 21, 22 to provide the inlet openings 33. Downstream of the inlet openings 33, the air cavity 28 is provided with expansion chambers 34 so as to serve the function of silencing the induction air before it is delivered to the carburetor air inlet 26. Thus, the partition 27 and resulting air chamber 28 serves as a silencing chamber to isolate mechanical sounds and also so as to silence the induction system.

Figure 3:
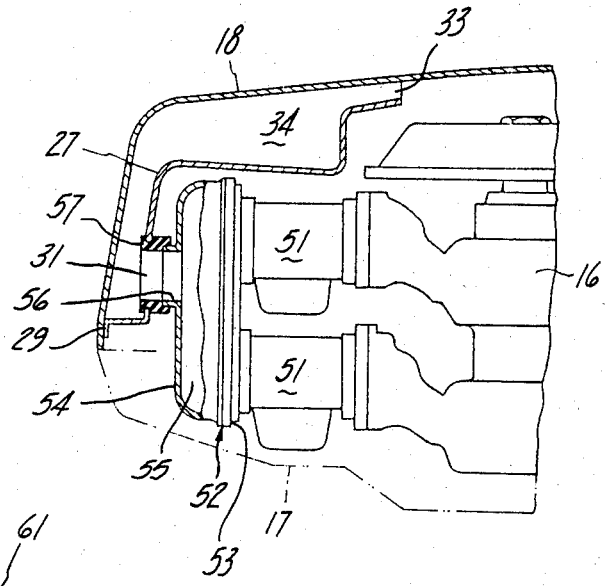
FIG. 3 is a partial view showing the pertinent portions of an outboard motor constructed in accordance with another embodiment of this invention.

Referring now to FIG. 3, this shows another embodiment wherein a further silencing effect is achieved. The outer cowling construction is the same as the embodiment of FIGS. 1 and 2, and for that reason, the same components have been identified by the same reference numeral and will not be described again.

In this embodiment, the engine 16 is provided with two carburetors 51, one for each cylinder of the engine 16. An intake device, indicated generally by the reference numeral 52, has a tray portion 53 that is affixed to the carburetors 51 and which has outlet openings in registry with the inlets to the carburetors 51. A cover portion 54 is affixed to the tray portion 53 and with it defines an expansion chamber 55. The cover portion 54 has an inlet opening 56 that is sealingly engaged by a elastomeric collar 57 that is received around the partition opening 31 and which affords a resilient connection and air path between the expansion chamber 34 of the cowling and the expansion chamber 55 of the intake device 52. Therefore, with this embodiment, two separate expansion chambers are provided so that the induction air is permitted to expand twice and further improve the silencing of the system.

Figure 4:
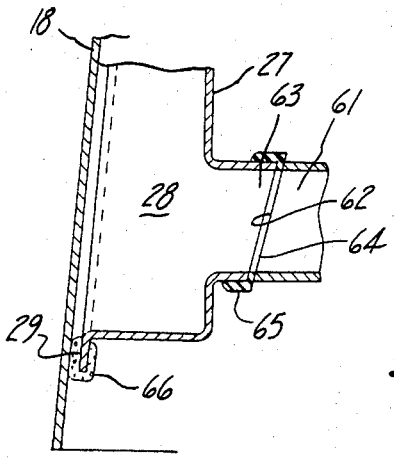
FIG. 4 is a partial cross-sectional view of a further embodiment of the invention.

In the embodiments thus far described, the connection between the outlet opening of the cowling partition and the inlet opening of either the carburetors, as in the embodiments of FIGS. 1 and 2, or the further expansion device, as in the embodiment of FIG. 3, is a press fit connection. That is, an elastomeric sleeve achieves the sealing between these two openings. FIG. 4 illustrates an embodiment that facilitates such a connection, particularly in those instances where the outer cowling is attached to the lower tray by movement in a generally downward direction.

In this embodiment, an induction system inlet is indicated generally by the reference numeral 61. The inlet 61 may either constitute that of the carburetors per se, as with the embodiment of FIG. 1 or 4 or an inlet to a further expansion device as with the embodiment of FIG. 3. The inlet 61 has an opening that is defined by an inclined plane 62. In a like manner, the cowling partition 27 has its outlet opening 63 formed with an inclined surface 64 that mates with the incline of the inlet 61. As with the previously described embodiments, an elastomeric sleeve 65 surrounds the baffle outlet opening 63. As should be readily apparent from an inspection of FIG. 4, the inclined surfaces 62, 64, permit good mating when the cowling members 18 are moved downwardly into engagement with the lower tray.

In the previously described embodiments, the partition flange 29 was affixed directly to the cowling member 18. However, it is possible to affix the partition 27 to either the carburetors or inlet device and have it sealingly engage the cowling 18. For this purpose, the flange 29 may be encircled by an elastomeric gasket 66 so as to effect sealing around its peripheral edge except for the portion that defines the air inlets 33.

It should be readily apparent that in each of the described embodiments, silencing is improved by providing an air chamber between the engine and the operator along the forwardmost side of the outer cowling. This air chamber acts to provide sound insulation. In addition, by using this air chamber as an inlet device, it is possible to function as an expansion chamber in the air induction system so as to achieve silencing. In the embodiment of FIG. 3, a further expansion device is also provided that further improves silencing. Although the partition 27 in each of the described embodiments has constituted a separate member which is affixed to either the outer cowling or to a portion of the engine and which sealingly engages the outer cowling, it should be readily apparent that the partition can be integrally connected to the outer cowling. In either construction providing the additional partition increases the rigidity of the outer cowling in addition to achieving the silencing effect.

Although the air chamber provided by the partition in the illustrated embodiments functions as an expansion chamber, it should be readily apparent that this chamber may also function as a resonance or tuning chamber or, alternatively, may be divided so as to perform each of these functions. Also, the configuration of the chamber may be determined not only by the partition but by the outer cowling per se.

Although a number of embodiments of the invention have been illustrated and described, it should be readily apparent that various changes and modifications may be made without departing from the spirit and scope of the invention, as defined by the appended claims.

I claim:

1. In an induction system for an outboard motor or the like comprising an engine having an induction system air intake and a protective outer cowling substantially enclosing said engine and consisting of a main cowling portion covering and surrounding the engine and a lower tray, said main cowling portion having a front face, a pair of side faces and a top face all integrally connected, the improvement comprising a partition of substantially U shape having a portion extending substantially across the rear side of the front face of said main cowling portion of said protective outer cowling and having the legs of said substantially U-shaped partition extending along the forwardmost portion of the side faces of said outer cowling and having a peripheral flange formed around at least a portion of the periphery of said partition and engaged with said main cowling portion to define an air chamber between said engine and an operator of said outboard motor or the like and to reinforce said main cowling portion, air inlet means into said air chamber comprising a pair of inlets defined each by a respective side of said partition in areas where said partition has no flange engaged with said main cowling portion and wherein said partition is spaced from the adjacent portions of said outer cowling portion, and an air outlet communicating said air chamber with said induction system air intake.

2. In an induction system as set forth in claim 1 wherein the outer cowling is provided with an air inlet opening.

3. In an induction system as set forth in claim 2 wherein the outer cowling air inlet opening is rearwardly facing and is configured to facilitate the separation of water from the intake air.

4. In an induction system as set forth in claim 1 wherein the air chamber functions as an expansion chamber in the induction system for achieving silencing of the air induction.

5. In an induction system as set forth in claim 4 further including a second expansion chamber communicating with the induction system air intake at its downstream end and with the partition air outlet at its upstream end.

6. In an induction system as set forth in claim 1 wherein the partition has an opening formed therein that forms the air outlet and further including an elastomeric member interposed between said opening and the induction system air intake for providing an air passage therebetween and sealing therewith.

7. In an induction system as set forth in claim 6 wherein the air outlet of the partition and the induction system air intake have mating surfaces that are inclined at an angle to facilitate connection therebetween upon assembly of the main cowling portion to the tray.

8. In an induction system as set forth in claim 1 wherein the partition peripheral flange carries gasket means for sealingly engaging the outer cowling.

9. In an induction system as set forth in claim 1 wherein the partition is affixed to the induction system air intake and its peripheral flange sealingly engages the outer cowling.

10. In an induction system as set forth in claim 9 wherein the peripheral flange of the partition carries gasket means for sealingly engaging the outer cowling.

* * * * *